US006402070B1

(12) United States Patent
Ishida et al.

(10) Patent No.: US 6,402,070 B1
(45) Date of Patent: Jun. 11, 2002

(54) BONE-MILL

(75) Inventors: Noriyuki Ishida; Shingo Tamabuchi; Akihiro Ookura; Tatsuo Oosugi, all of Kyoto; Nobuo Oka; Kazutoshi Koyama, both of Moriguchi, all of (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 09/512,935

(22) Filed: Feb. 25, 2000

(30) Foreign Application Priority Data

Feb. 25, 1999 (JP) ..... 11-047550

(51) Int. Cl.[7] ..... B02C 18/16
(52) U.S. Cl. ..... 241/236; 241/295
(58) Field of Search ..... 241/236, 100, 241/37.5, 36, 30, 295

(56) References Cited

U.S. PATENT DOCUMENTS 5,048,764 A * 9/1991 Flament ..... 241/236
5,062,576 A * 11/1991 Burda ..... 241/295
5,201,475 A * 4/1993 Nakagomi ..... 241/236
5,848,754 A * 12/1998 Becker et al. ..... 241/236
5,918,821 A * 7/1999 Grooms et al. ..... 241/100

* cited by examiner

*Primary Examiner*—Mark Rosenbaum
(74) *Attorney, Agent, or Firm*—Hogan & Hartson, L.L.P.

(57) ABSTRACT

A bone mill has a pair of cutter units, a first cutter unit and a second cutter unit. A bone to be crushed is taken in between the first cutter unit and the second cutter unit. While passing between the first cutter unit and the second cutter unit, the bone is crushed. Each cutter unit has a plurality of disks disposed in parallel to one another at regular intervals. Each disk is provided on the periphery thereof with blades for crushing the bone. The cutter units are positioned such that the disks of the first cutter unit are fitted in the gaps between adjacent disks of the second cutter unit. Both the disks of the first cutter unit and the disks of the second cutter unit are mutually inwardly rotated. Accordingly, when a bone to be crushed is supplied between the cutter units, the bone is taken in by and between the disks of the first cutter unit and the disks of the second cutter unit, both sets of disks being mutually inwardly rotated. Thus, the blades of the disks bite the bone, causing the bone to be broken. While passing between the disks of the first cutter unit and the disks of the second cutter unit, the bone is crushed by these disks so positioned as to be fitted in each other.

15 Claims, 16 Drawing Sheets

BONE-MILL

This application is based on an application No. 11-47550 filed in Japan, the content of which is incorporated hereinto by reference.

BACKGROUND OF THE INVENTION

1. Field of the Invention

The present invention relates to a bone mill for crushing, into particles having the desired size, a bone (human bone) taken out from a living body at its suitable part.

Bone particles obtained by crushing a bone with a bone mill, are used as a spacer or the like for an artificial bone filled in the prosthesis part of the living body.

2. Description of Related Art

In vertebrate animals, the bones serve as a form element which constitutes the framework. In particular, the human bones are arranged to take physical exercise together with the muscles, and serve as the foundation of a variety of parts of the human body. Further, the human bones are important organs for maintaining the body form and the like.

A human bone is structurally provided on the surface thereof with the white periosteum. The periosteum through which nerves and blood vessels pass, is related to nutrition intake and growth. On the other hand, it is known that the outer layer of a bone is hard because it is made of tight matter (hard matter), and that the inner layer is spongy and porous.

Technology in the surgical medicare field has made rapid progress. In particular, artificial living-body materials, prosthetic tools and the like are always improved in performance, and a large number of persons share in the benefit.

The artificial living-body materials of prior art are neither poisonous nor stimulative to a living body, but most of them have no biological affinity. Accordingly, when bone cement is used for fixing a prosthetic tool to the bone or for filling the gap between a prosthetic tool and the bone, this involves the likelihood that the heat of polymerization of the bone cement exerts an adverse effect on the living body, or that due to changes with the passage of time, the bone cement is loosened to deteriorate the safety.

In view of the foregoing, a bone taken out from a living body at its suitable part has conventionally been crushed into particles having the desired size (e.g., 4 $mm^2$~10 $mm^2$), and the bone particles thus crushed have been used as a spacer or filler for filling the gap between the prosthesis tool and the bone. According to this method, such a spacer or filler has an affinity to the bone because human bone is used. Thus, this method has no concern for adverse effect of the heat of polymerization to the living body and for the looseness due to changes with the passage of time.

To crush a bone taken out from a living body into fine bone particles, it is required to crush the bone with a hammer or an edged tool. This disadvantageously requires working skill and time. In particular, the bone taken from a living body is excellent in tenacity, but hard. Further, blood vessels and a variety of nerves are contained in the surface periosteum. It is therefore difficult to crush the bone. Further, the crushed bone particles are disadvantageously not uniform.

In view of the foregoing, a variety of bone mills are produced and commercially available. FIG. 1 shows an example of the commercially available bone mills. To crush a bone with this bone mill, the bone is previously treated. More specifically, the bone taken from a living body is cut into pieces of about 3 $cm^2$ with a bone saw or the like. A cut bone piece is inserted into an inlet port (which is disposed at a pushing-out portion such as a syringe) of the bone mill in FIG. 1. Then, the inserted bone is pushed in with one hand, and a switch for reciprocating a blade arranged to cut the bone, is pressed with the other hand. This causes nitrogen gas to be blown out to operate the blade.

This bone mill requires a previous treatment of cutting a bone into pieces having a predetermined size. Further, the size of crushed bone particles varies with the manner in which the bone mill is operated. Thus, it takes time before the operator is used to the bone mill. Further, bone crushing takes as much as 3~5 minutes.

According to another example of the commercially available bone mills, projecting blades are disposed on a shaft of rotation, and a bone is pushed to these rotational blades such that the bone is scraped off.

In the bone mill having the arrangement above-mentioned, the bone should always be pressed with the hand. This disadvantageously gives trouble. Further, bone crushing takes at least about 5 minutes.

SUMMARY OF THE INVENTION

In view of the foregoing, the present invention is proposed with the main object of providing a bone mill having a novel mechanism capable of crushing a bone into particles having the desired size in a short period of time.

It is another object of the present invention to provide a bone mill easy to handle and operate.

It is a further object of the present invention to provide a bone mill capable of crushing a bone without any loss.

It is still another object of the present invention to provide a bone mill which can readily be cleaned and sterilized after used.

A bone mill according to the present invention has a pair of first cutter unit and second cutter unit. A bone to be crushed is taken in between the first cutter unit and the second cutter unit. While passing between the first cutter unit and the second cutter unit, the bone is crushed.

Each cutter unit has a plurality of disks disposed in parallel to one another at regular intervals. Each disk is provided on the periphery thereof with a blade for crushing a bone. The cutter units are positioned such that the disks of the first cutter unit are fitted in the gaps between adjacent disks of the second cutter unit. Both the disks of the first cutter unit and the disks of the second cutter unit are mutually inwardly rotated. Accordingly, when a bone to be crushed is supplied between the cutter units, the bone is taken in by and between the disks of the first cutter unit and the disks of the second cutter unit, both disks being mutually inwardly rotated. Thus, the blades of the disks bite the bone, causing the same to be broken. While passing between the disks of the first cutter unit and the disks of the second cutter unit, the bone is crushed by these disks so positioned as to be fitted in each other.

Preferably, each of the first and second cutter units has small-diameter disks and large-diameter disks such that a bone to be crushed is readily taken in. The blades formed on the large-diameter disks readily take in a bone to be crushed, while the blades formed on the small-diameter disks readily crush the bone.

These and other features, objects and advantages of the present invention will be more fully apparent from the following detailed description set forth below when taken in conjunction with the accompanying drawings.

DESCRIPTION OF THE PREFERRED EMBODIMENTS

Figure 1:
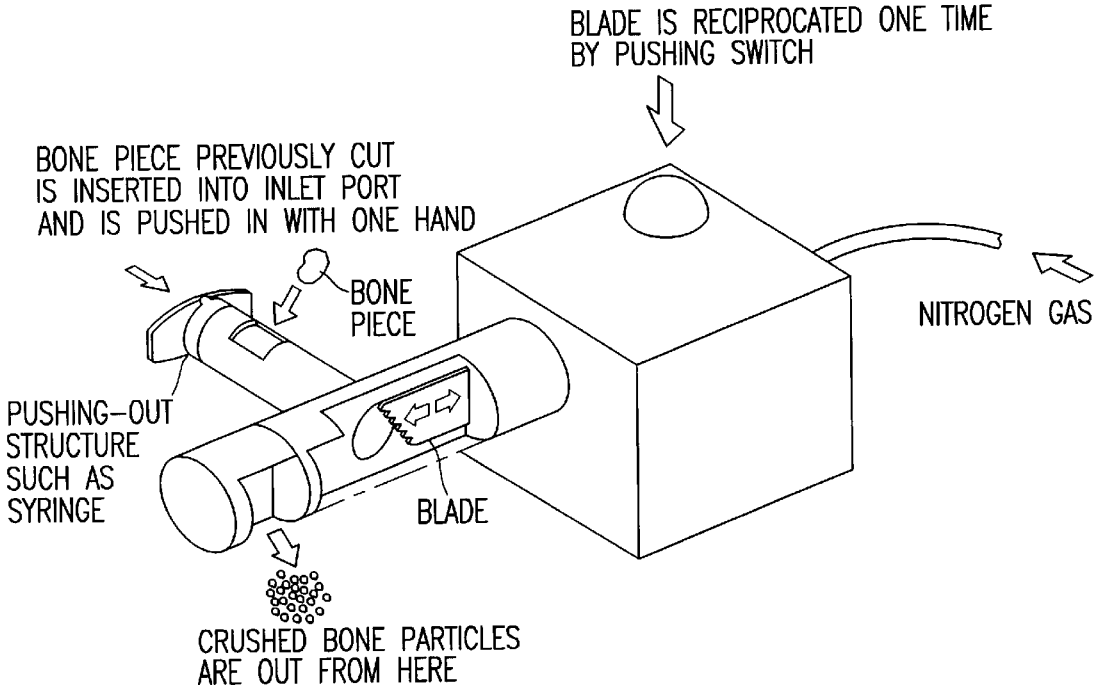
FIG. 1 PRIOR ART
FIG. 1 is a view illustrating an example of the commercially available bone mills of prior art.
Figure 2:
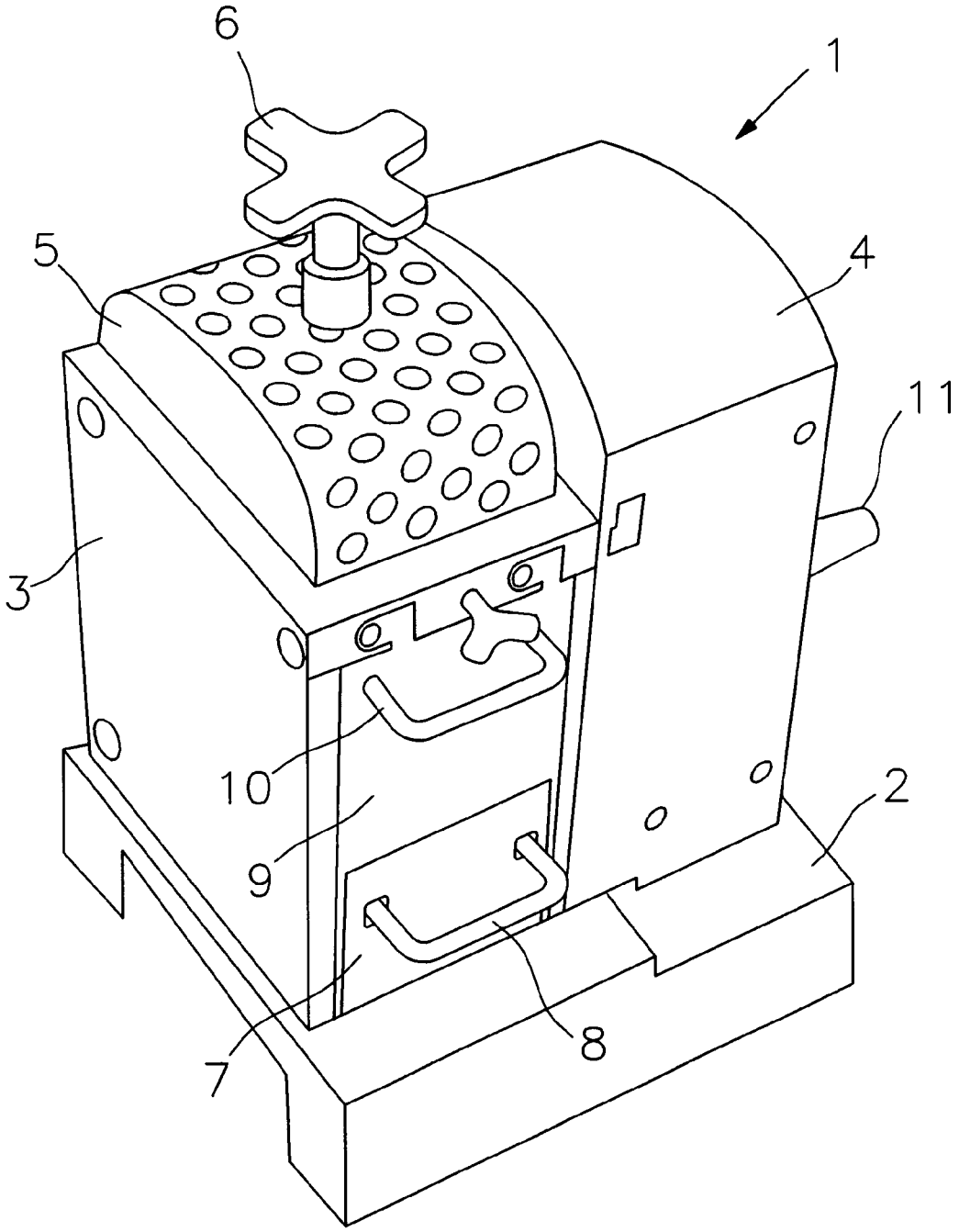
FIG. 2 is a perspective view of a bone mill according to an embodiment of the present invention.

FIG. 2 is a perspective view of a bone mill according to an embodiment of the present invention. The bone mill of this embodiment is provided on a base 2 thereof with a mill case 3 and a gearbox 4. The mill case 3 and the gearbox 4 are adjacent and connected to each other. The mill case 3 is opened at its top on which a removable lid 5 is mounted. The lid 5 is provided at the top center thereof with a knob 6. When attaching or removing the lid 5, the knob 6 is held by the hand. As will be discussed later, according to this embodiment, the knob 6 has a portion projecting into the inside of the lid 5 such that the bone in the mill case 3 is pushed downwardly by the knob 6.

The mill case 3 is provided at a lower portion thereof with a container 7 which can be pulled out. The container 7 is arranged to receive crushed bone particles obtained by crushing the bone in the mill case 3. The container 7 has a grip 8 to be used when pulling out the container 7.

Each lateral wall 9 of the mill case 3 is removable as will be discussed later. In this connection, each lateral wall 9 has a grip 10.

The gearbox 4 houses a reduction gear mechanism to be discussed later. There projects, from the gearbox 4, an input shaft 11 for giving an external drive force to this reduction gear mechanism.

Figure 3:
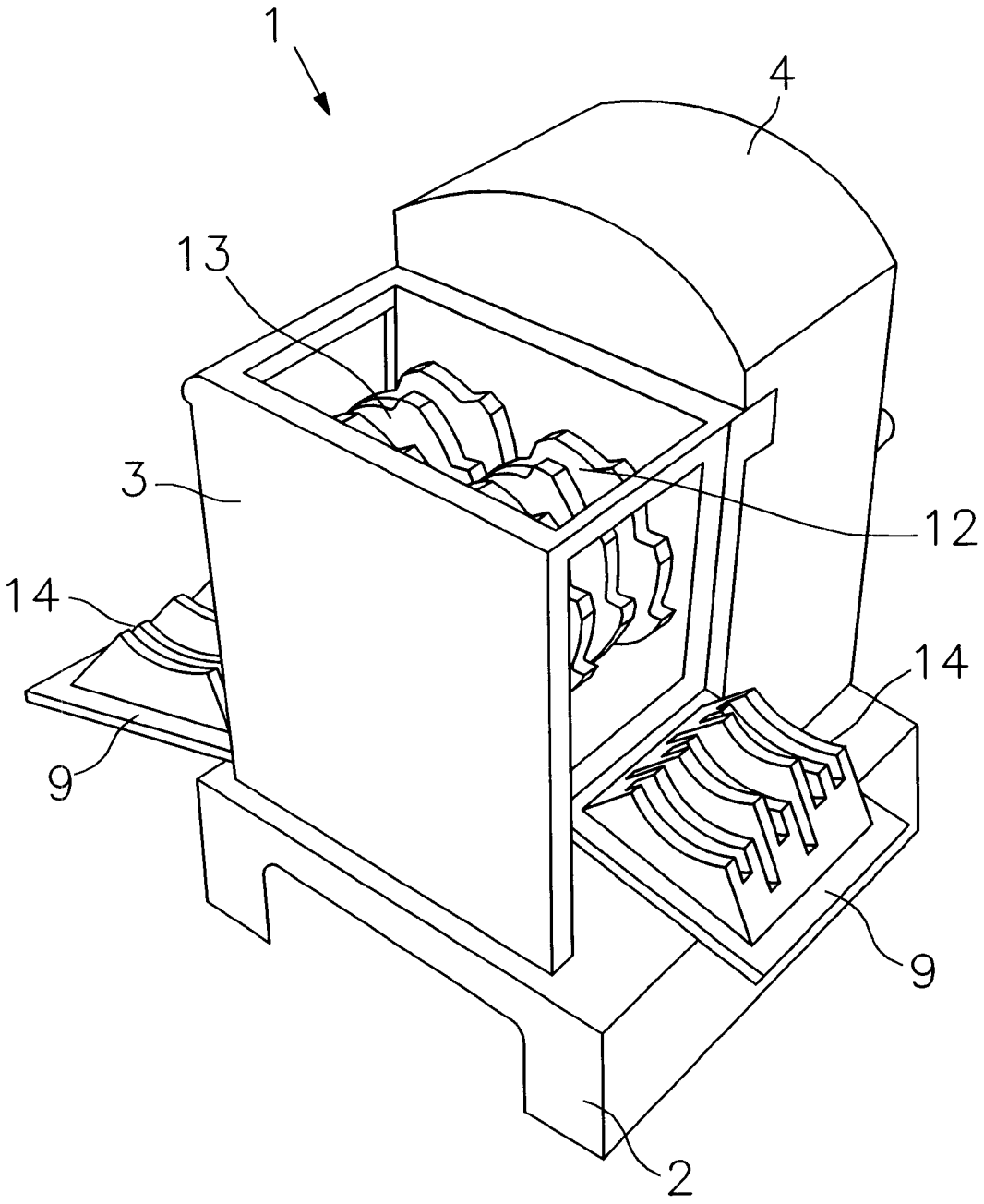
FIG. 3 is a perspective view of the bone mill in FIG. 2 with its lid removed and with a pair of lateral walls opened.

FIG. 3 is a perspective view of the bone mill 1 with the lid 5 removed and with a pair of lateral walls 9 opened. As shown in FIG. 3, the lateral walls 9 forming the mill case 3 can be opened by rotating outwardly their upper sides around their lower sides. Further, the lateral walls 9 can be removed from the mill case 3 from the state shown in FIG. 3.

As will be discussed later, the mill case 3 is provided inside thereof with a pair of cutter units 12, 13. Each lateral wall 9 has a duster 14 projecting into the inside of the mill case 3.

Figure 4:
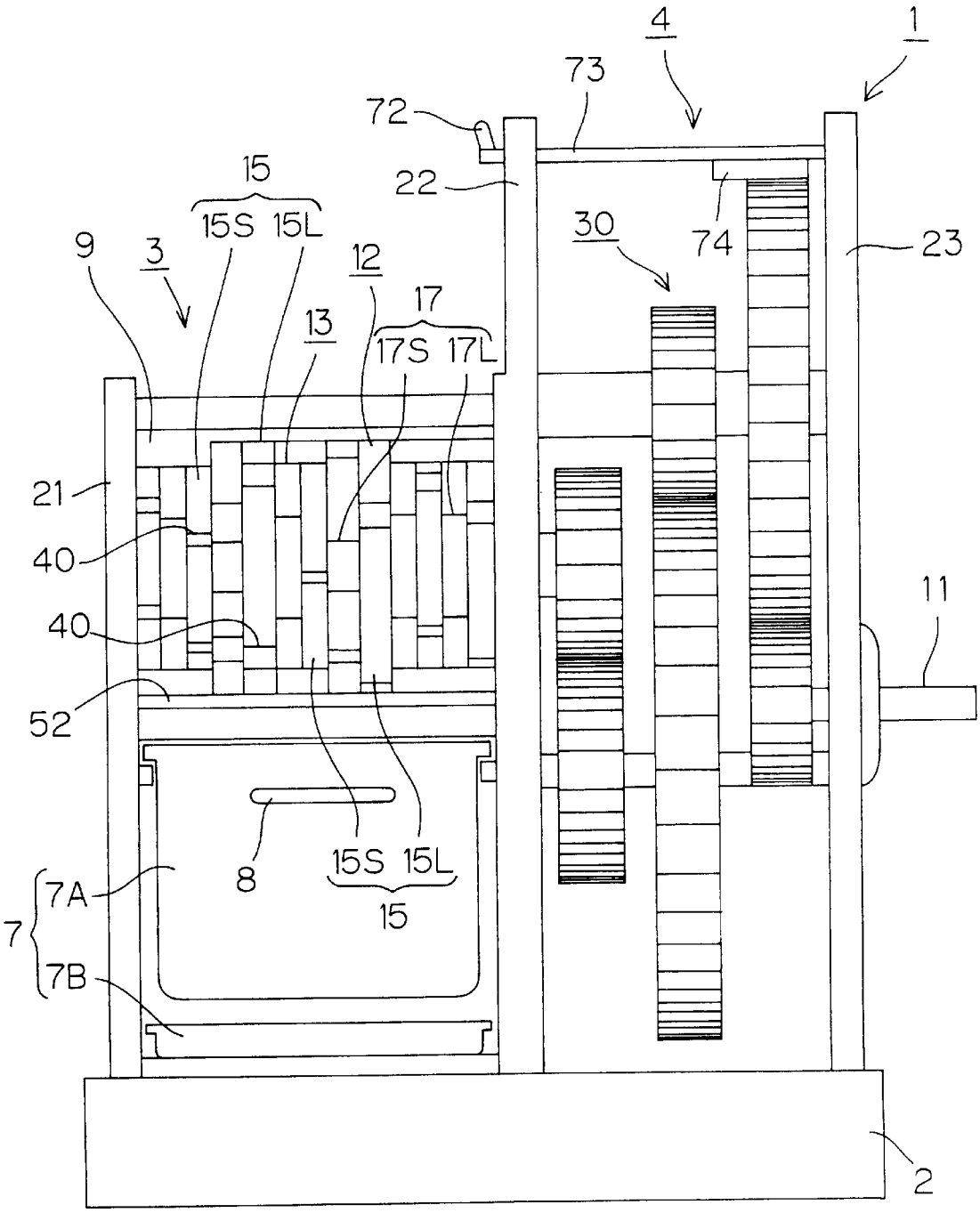
FIG. 4 is a front view of the bone mill in FIG. 2 with both the lid and the front lateral wall removed and also with the gearbox cover removed.
Figure 5:
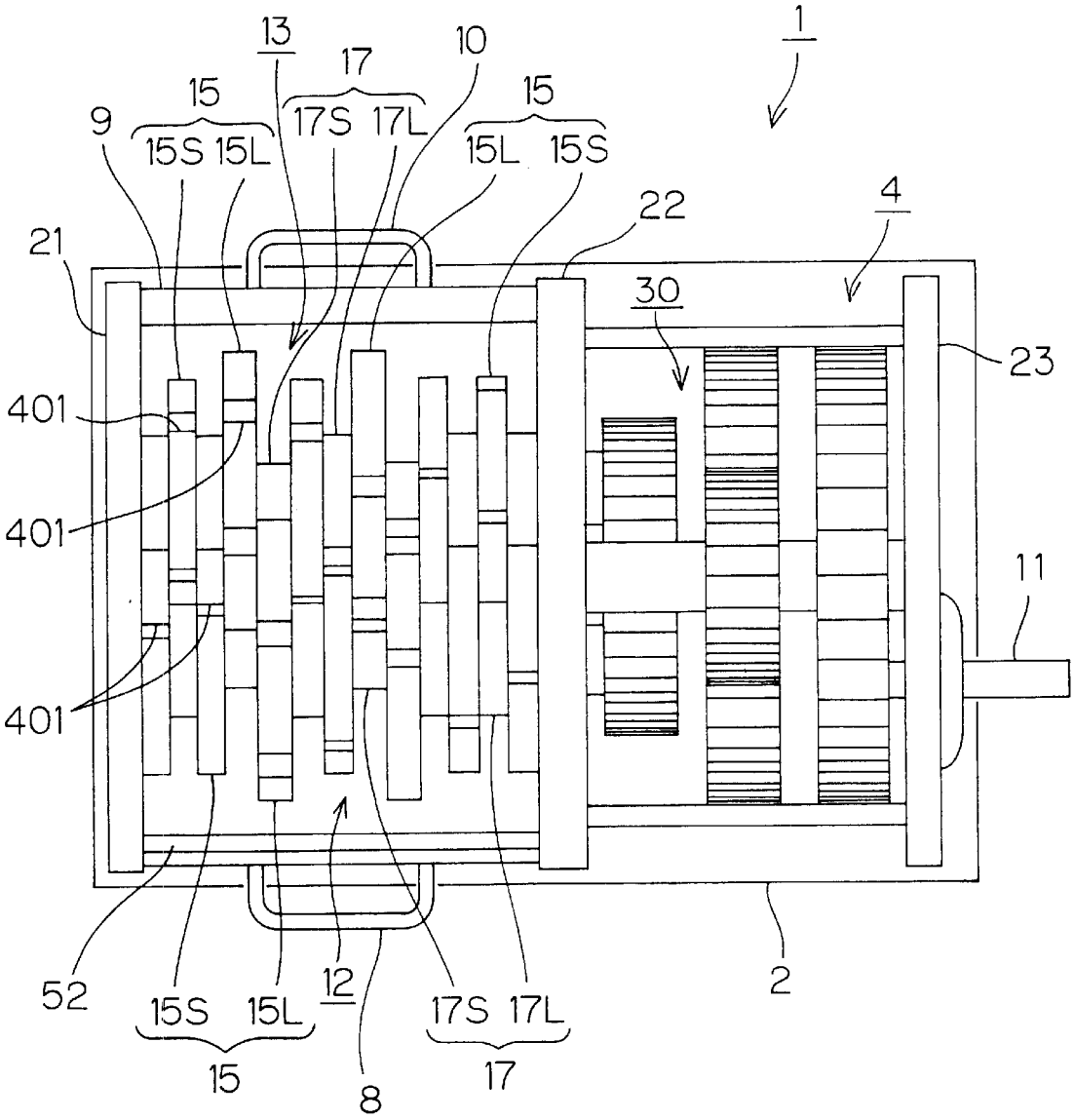
FIG. 5 is a plan view of the bone mill in FIG. 4.

FIG. 4 is a front view of the bone mill 1 with both the lid 5 and the front lateral wall 9 removed and also with the cover of the gearbox 4 removed. FIG. 5 is a plan view of the bone mill 1 in FIG. 4.

Referring to FIGS. 4 and 5, the bone mill 1 has three support walls 21, 22, 23 which stand from the base 2 and which are parallel to one another. The mill case 3 is defined by the left support wall 21, the center support wall 22 and a pair of front and rear lateral walls 9 (the front lateral wall 9 is not shown because it is removed). The mill case 3 houses a pair of first cutter unit 12 and second cutter unit 13. The both sides of each of the cutter units 12, 13 are rotatably supported by the support walls 21, 22. Each of the cutter units 12, 13 has a plurality of disks 15 which are parallel to one another and which are disposed at regular intervals. Each of the disks 15 is provided on the peripheral surface thereof with a plurality of blades 40. The disks 15 of each of the cutter units 12, 13 are connected, at their center portions, to one another by a shaft 17 extending at a right angles to the disks 15. The both ends of the shaft 17 are rotatably supported by the support walls 21, 22. The support walls 21, 22 support the cutter units 12, 13 such that no gaps are substantially produced between the inner surfaces of the support walls 21, 22 and the end-side disk lateral surfaces of the cutter units 12, 13.

The shafts 17 of the first and second cutter units 12, 13 are substantially horizontally disposed in parallel to each other. The disks 15 of the first cutter unit 12 are so positioned as to be fitted in the gaps between adjacent disks 15 of the second cutter unit 13. Both the first cutter unit 12 and the second cutter unit 13 are mutually inwardly rotated. Thus, a bone to be crushed which has been supplied onto the first and second cutter units 12, 13, is taken into the lower center portions of the cutter units 12, 13 by the blades 40 of the mutually inwardly rotating disks 15 of the cutter units 12, 13. Then, the bone passes between the cutter units 12, 13 from top to bottom, causing the bone to be crushed.

The bone particles thus crushed fall in the container 7 disposed at a lower portion of the mill case 3.

The center support wall 22 also serves as a partition wall between the mill case 3 and the gearbox 4. The gearbox 4 is defined by the center support wall 22 and the right support wall 23. The gearbox 4 houses a reduction gear mechanism 30 as a drive force transmission mechanism. The reduction gear mechanism 30 comprises a plurality of gears arranged such that a rotational force given to the input shaft 11 from the outside is reduced in speed to increase the torque of rotation, and then transmitted to the shafts 17 of the first and second cutter units 12, 13.

Figure 6:
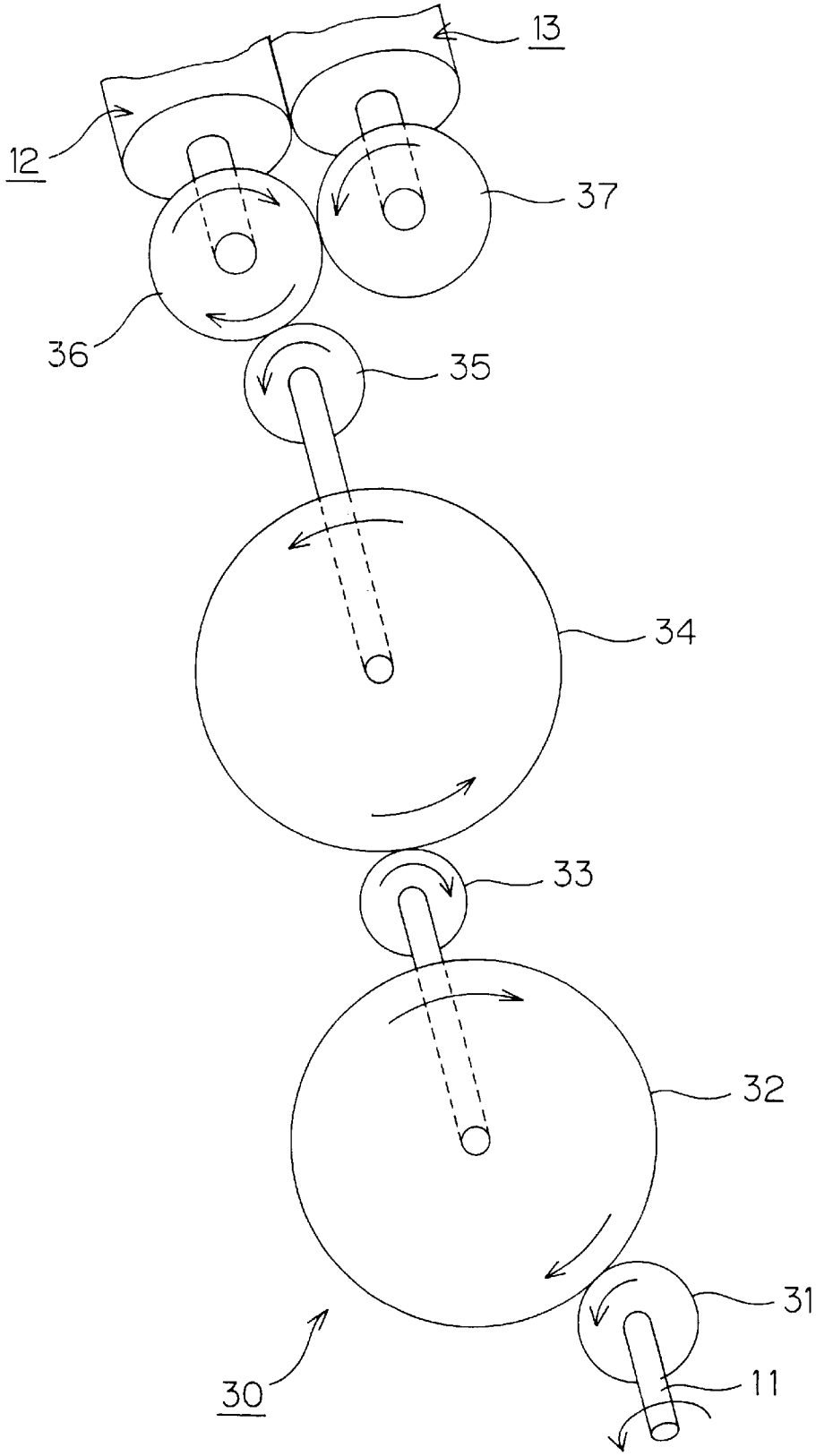
FIG. 6 is an exploded view of a reduction gear mechanism.

FIG. 6 is an exploded view of the reduction gear mechanism 30, illustrating the transmission of a rotational force.

The rotational force given to the input shaft 11 from the outside, is transmitted from a small-diameter first gear 31 to a large-diameter second gear 32. The second gear 32 is coaxially connected to a small-diameter third gear 33. The third gear 33 is meshed with a large-diameter fourth gear 34. Thus, the rotational force of the second gear 32 is transmitted to the third gear 33 and the fourth gear 34. The fourth gear 34 is coaxially connected to a small-diameter fifth gear 35. The fifth gear 35 is meshed with a sixth gear 36 connected to the shaft 17 of the first cutter unit 12. The sixth gear 36 is meshed with a seventh gear 37 connected to the shaft 17 of the second cutter unit 13. The seventh gear 37 is not meshed with the fifth gear 35. Accordingly, when the fifth gear 35 is rotated, the sixth gear 36 and the first cutter unit 12 are rotated clockwise in FIG. 6, while the seventh gear 37 and the second cutter unit 13 are rotated counter-clockwise in FIG. 6.

In this embodiment, the sixth gear 36 is different in the number of teeth from the seventh gear 37. For example, the sixth gear 36 has 25 teeth, while the seventh gear 37 has 15 teeth. Accordingly, the first cutter unit 12 is different in rotational speed from the second cutter unit 13.

The gear arrangement and the teeth numbers in the reduction gear mechanism 30 of this embodiment, are mere examples. More specifically, there may be used any gear mechanism (drive force transmission mechanism) as far as it is arranged such that a rotational force given to the input shaft 11 is transmitted to the first and second cutter units 12, 13, and that the first and second cutter units 12, 13 are mutually inwardly rotated, preferably at different speeds of rotation.

Figure 7:
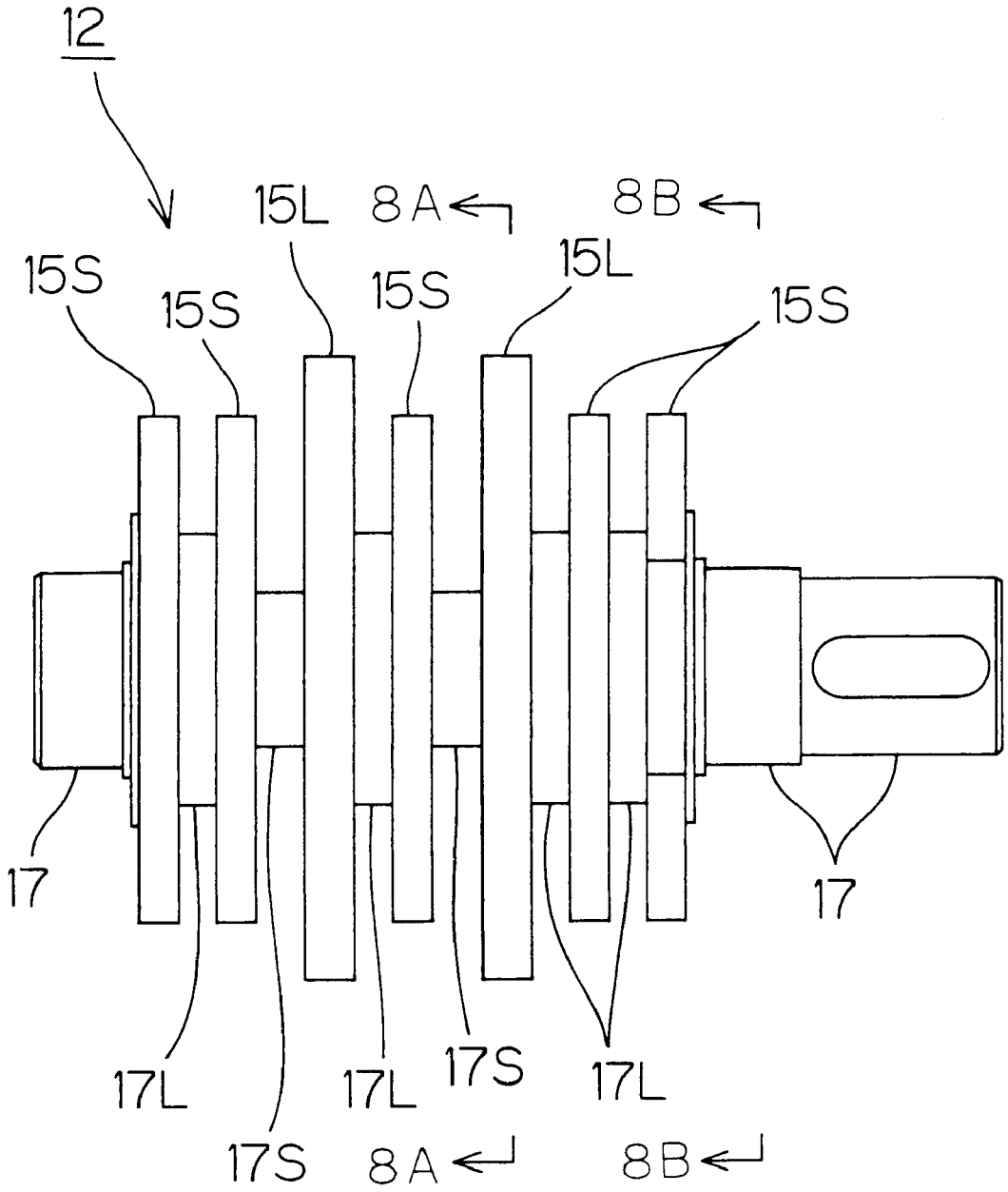
FIG. 7 is a plan view of a first cutter unit.
Figure 8A:
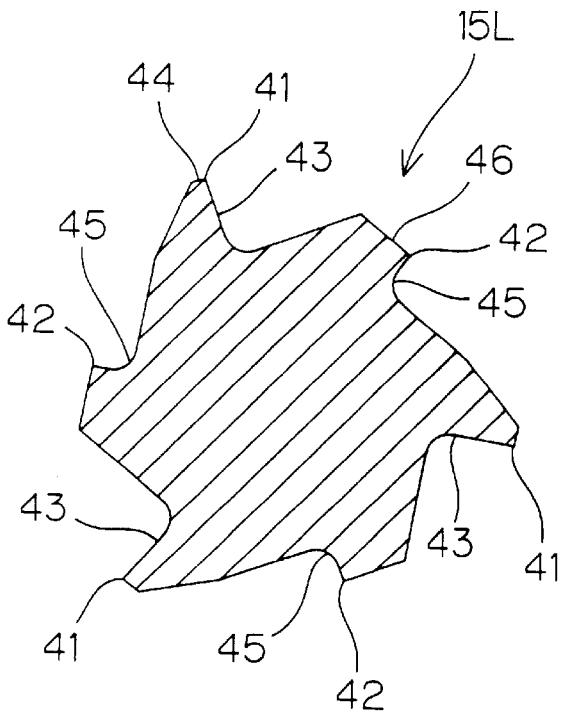
FIG. 8A is a view taken along the arrow 8A—8A in FIG. 7.
Figure 8B:
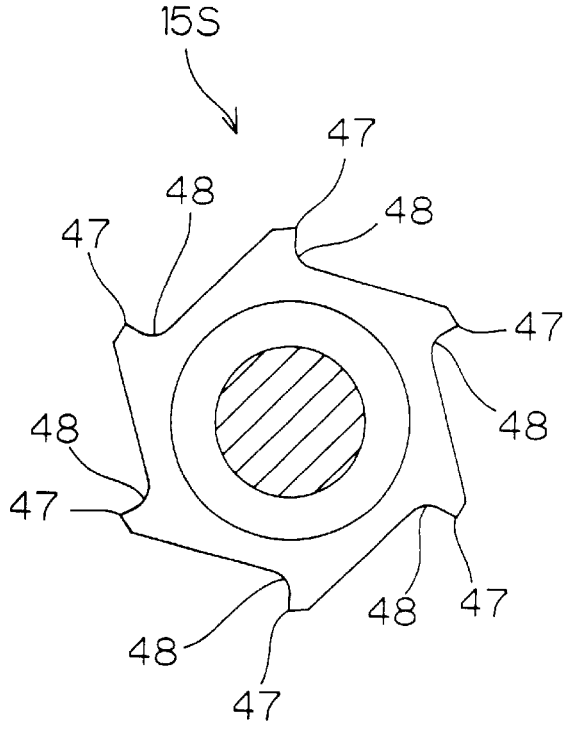
FIG. 8B is a view taken along the arrow 8B—8B in FIG. 7.

FIG. 7 is a plan view of the first cutter unit 12. FIG. 8A is a view taken along the arrow 8A—8A in FIG. 7, while FIG. 8B is a view taken along the arrow 8B—8B in FIG. 7. For convenience' sake, the blades of the disks 15 are not shown in FIG. 7 and only one disk is shown in each of FIG. 8A and FIG. 8B.

Referring to FIG. 7, the first cutter unit 12 is entirely made in a unitary structure of metal such as stainless steel. That is, the first cutter unit 12 in this embodiment is formed by cutting stainless steel. The reason of why the first cutter unit 12 is made in a unitary structure of metal, is because it is necessary to prevent dirt, blood or the like from entering the gaps between the disks 15 and the shaft 17.

The first cutter unit 12 may be made in a unitary structure of titanium, ceramics and the like, instead of stainless steel. Further, the first cutter unit 12 may be made by casting or the like, instead of cutting.

The disks 15 of the first cutter unit 12 disposed in parallel at regular intervals, are connected at their centers by the shaft 17 extending at a right angle to the disks 15. The shaft 17 for connecting the disks 15 has different diameters at its different parts. More specifically, the disks 15 of the second cutter unit 13 are fitted in the gaps between adjacent disks 15 of the first cutter unit 12. Accordingly, the shaft 17 of the first cutter unit 12 has small-diameter portions 17S and large-diameter portions 17L according to the outer peripheries (rotational loci) of the disks 15 of the second cutter unit 13.

In this embodiment, out of the disks 15, each of the small-diameter disks 15S has a thickness of 4 mm and each of the large-diameter disks 15L has a thickness of 5 mm. Thus, the large-diameter disks 15L are thicker in thickness than the small-diameter disks 15S. This is to assure the strength of the large-diameter disks 15L.

As shown in FIG. 8A, a large-diameter disk 15L has three biting blades 41 at regular angular intervals of 120° in the circumferential direction, and three crushing blades 42 between adjacent biting blades 41. Each biting blade 41 is so arranged as to draw a larger rotational locus, while each crushing blade 42 is so arranged as to draw a smaller rotational locus. Each of the biting and crushing blades 41, 42 is formed by the ridgeline in the thickness direction of the large-diameter disk 15L. To form the biting blades 41, there are formed, in the large-diameter disk 15L, rake portions 43 which have been cut, in the form of arcuate concaves, in the disk center direction from the disk peripheral surface. That is, the biting blades 41 are formed by those ridgelines in the disk thickness direction which are formed by the tips of the rake portions 43 and disk peripheral faces 44. Similarly, the crushing blades 42 are formed by the ridgelines formed by rake portions 45 and peripheral faces 46.

When the rake portions 43, 45 are made as cut, in the form of arcuate concaves, in the disk center direction from the disk peripheral surface, crushed bone pieces and particles are advantageously not accumulated in the rake portions 43, 45.

When the biting blades 41 are cut at the rear sides thereof such that the tips of the biting blades 41 are made in the form of sharpened points of triangles, the biting blades 41 advantageously readily bite the bone to be crushed.

In this embodiment, each large-diameter disk 15L has three biting blades 41, and the remaining three blades are made in the form of crushing blades 42 arranged to draw small-diameter rotational loci. Accordingly, the number of the biting blades 41 does not become excessive to prevent the load exerted to the large-diameter disk 15L from being excessive.

As shown in FIG. 7, the first cutter unit 12 has two large-diameter disks 15L. The biting and crushing blades 41, 42 of one large-diameter disk 15L are angularly shifted by 20° from the biting and crushing blades 41, 42 of the other large-diameter disk 15L. Thus, the biting blades 41 of the two large-diameter disks 15L bite the bone at different timings, thus enhancing the biting efficiency.

The following description will discuss a small-diameter disk 15S with reference to FIG. 8B. The small-diameter disk 15S has six crushing blades 47 at regular angular intervals of 60° in the rotation direction. The crushing blades 47 are also formed by ridgelines in the thickness direction of the small-diameter disk 15S.

Accordingly, rake portions 48 are formed in connection with the crushing blades 47. Likewise the rake portions 43, 45 formed in each large-diameter disk 15L, the rake portions 48 are made as cut, in the form of arcuate concaves, in the disk center direction from the disk peripheral surface.

As shown in FIG. 7, the first cutter unit 12 has five small-diameter disks 15S. In the respective five small-diameter disks 15S from the right side to the left side in FIG. 7, the crushing blades 47 are successively angularly shifted by 10° in the rotation direction.

Accordingly, out of the crushing blades 47 of the five small-diameter disks 15S disposed from the right side to the left side in FIG. 7, a crushing blade 47 of the right-end small-diameter disk 15S first contributes to crushing of the bone, and then a crushing blade 47 of the second small-diameter disk 15S from the right-end one, contributes to crushing of the bone. Then, crushing blades 47 of the third, fourth and fifth small-diameter disks 15S from the right-end one, successively contribute to crushing of the bone. Thus, crushing blades 47 of all the small-diameter disks 15S do not simultaneously contribute to crushing of the bone, but crushing blades 47 of a plurality of small-diameter disks 15S successively contribute to crushing of the bone. Accordingly, the load simultaneously applied to the entire cutter unit 12 is small, thus causing the cutter unit 12 to be advantageously rotated with a small drive force.

Figure 9:
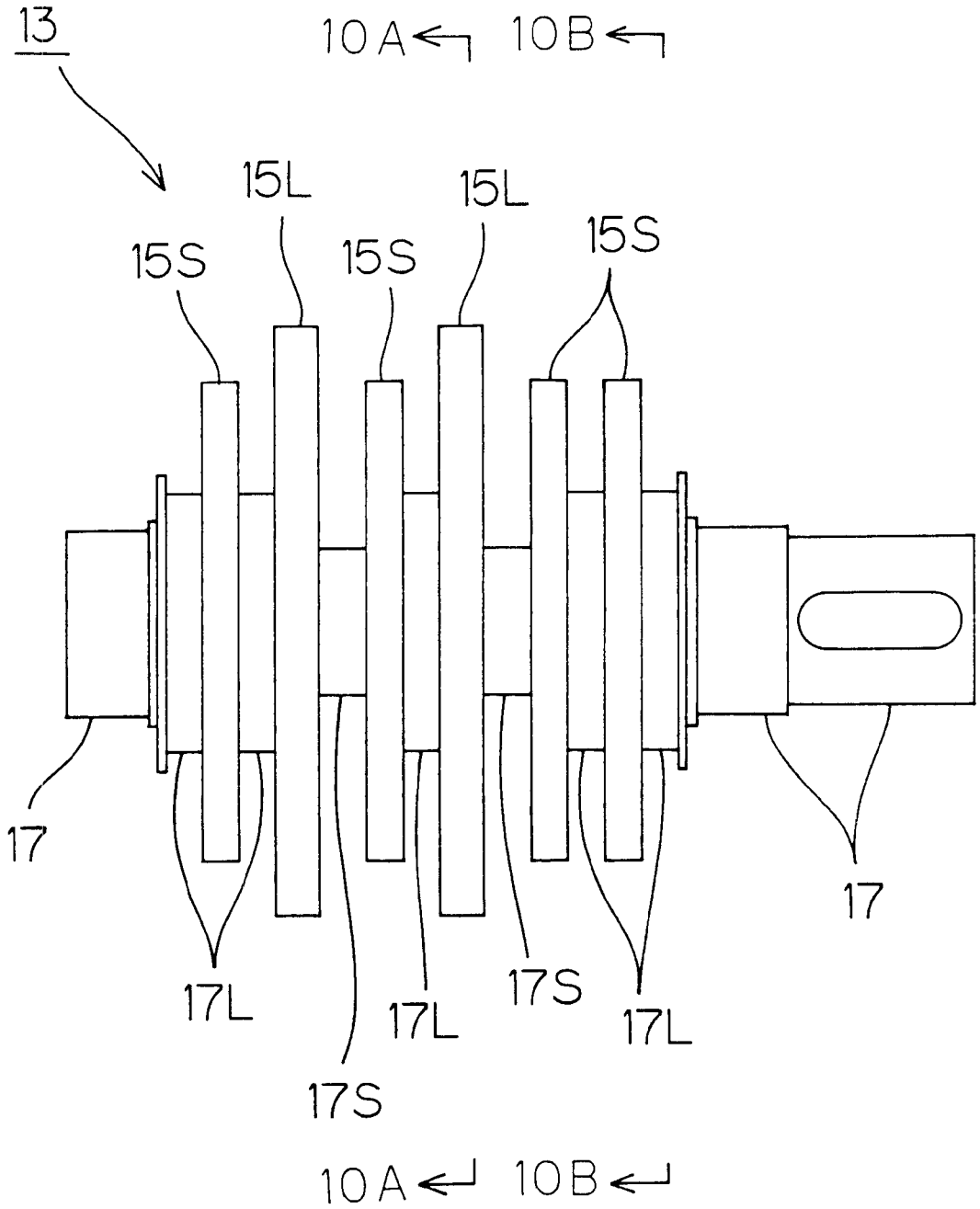
FIG. 9 is a plan view of a second cutter unit.
Figure 10A:
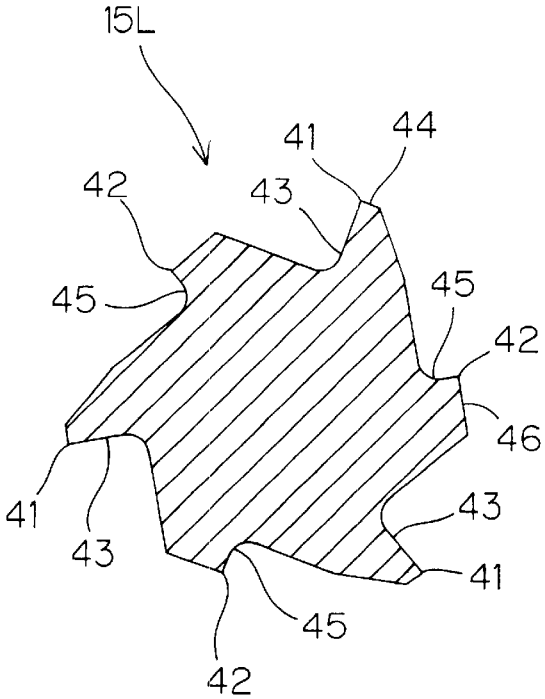
FIG. 10A is a view taken along the arrow 10A—10A in FIG. 9.
Figure 10B:
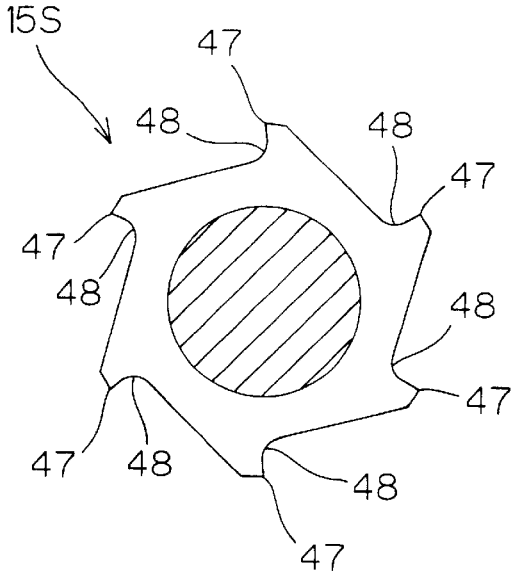
FIG. 10B is a view taken along the arrow 10B—10B in FIG. 9.

FIG. 9 is a plan view of the second cutter unit 13. FIG. 10A is a view taken along the arrow 10A—10A in FIG. 9, while FIG. 10B is a view taken along the arrow 10B—10B in FIG. 9.

The second cutter unit 13 has two large-diameter disks 15L and four small-diameter disks 15S. Each of the large-diameter disks 15L has a thickness of 5 mm, and each of the small-diameter disks 15S has a thickness of 4 mm, these thicknesses being the same as those of the disks of the first cutter unit 12. In the second cutter unit 13, too, the shaft 17 has small-diameter portions 17S and large-diameter portions 17L according to the outer peripheries (rotational loci) of the disks of the first cutter unit 12 which are fitted in the gaps between adjacent disks 15 of the second cutter unit 13.

In the second cutter unit 13, the shapes and arrangement of the large-diameter disks 15L and the small-diameter disks 15S, are basically the same as those of the disks 15L, 15S of the first cutter unit 12 discussed with reference to FIGS. 8A and 8B. When viewed in the same direction, the disks 15 of the first cutter unit 12 and the disks 15 of the second cutter unit 13 are symmetric. As to other arrangement, the first and second cutter units 12 13 are the same as each other. Therefore, like parts are designated by like reference numerals and the description thereof is here omitted.

Figure 11:
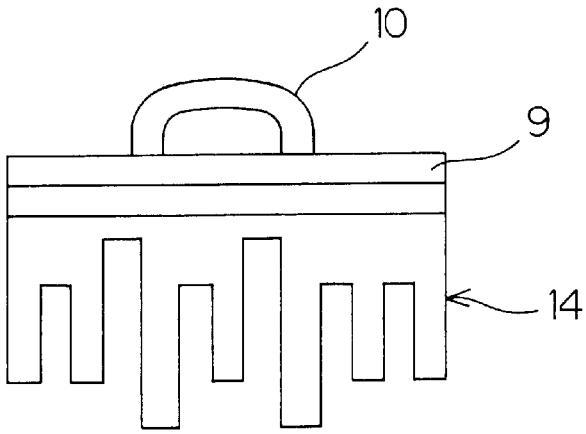
FIG. 11 is a plan view illustrating the arrangement of a lateral wall and a duster projecting from the inner surface of the lateral wall.
Figure 12:
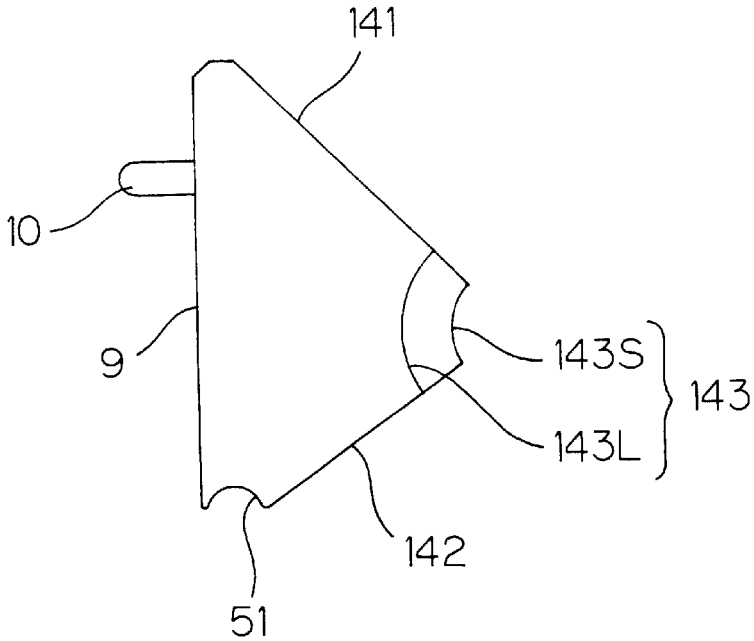
FIG. 12 is a side view illustrating the arrangement of a lateral wall and a duster projecting from the inner surface of the lateral wall.

FIG. 11 is a plan view illustrating the arrangement of a lateral wall 9 and a duster 14 projecting from the inner surface of the lateral wall 9. FIG. 12 is a side view of FIG. 11. FIGS. 11 and 12 show the lateral wall 9 and the duster 14 at the side of the second cutter unit 13. According to this embodiment, the lateral wall 9 and the duster 14 are made in a unitary structure by cutting stainless steel. Likewise the cutter units 12, 13, the unitary structure of the lateral wall 9 and the duster 14 has no gap into which blood or the like enters, thus facilitating cleansing and sterilization.

The dusters 14 prevents bone particles from entering the gaps between the inner surfaces of the lateral walls 9 and the cutter units 12, 13. The dusters 14 also cause crushed bone particles to fall down when the crushed bone particles are rotated as attached to the cutter units 12, 13. In this connection, as shown in FIG. 11, the duster 14 has, in plan elevation, concaved portions and convexed portions projecting like the teeth of a comb. These concaved and convexed portions are corresponding to the disks 15 and the shaft 17 of the second cutter unit 13, and the convexed portions are fitted in the gaps between adjacent disks 15.

Further, as shown in FIG. 12, each duster 14 is made substantially in the form of an equilateral triangle having an upper side 141 extending as inclined inwardly downwardly from an upper portion of the lateral wall 9, and a lower side 142 extending as inclined inwardly upwardly from a lower portion of the lateral wall 9. The vertex of this substantially equilateral triangle is made in the form of an arcuate concave 143 facing to the shaft 17 of the second cutter unit 13. The arcuate concave 143 has an arcuate concave portion 143L corresponding to the large-diameter portion 17L, and an arcuate concave portion 143S corresponding to the small-diameter portion 17S.

The lateral wall 9 is provided at the bottom side thereof with an engagement concave 51 which is hollowed in the form of a semicircle in side elevation. This engagement concave 51 is fitted to a shaft 52 (See FIGS. 4 and 5) of the mill case 3. Thus, by rotating the whole lateral wall 9 together with the duster 14, the lateral wall 9 together with the duster 14 can be removed from or attached to the mill case 3.

Figure 13:
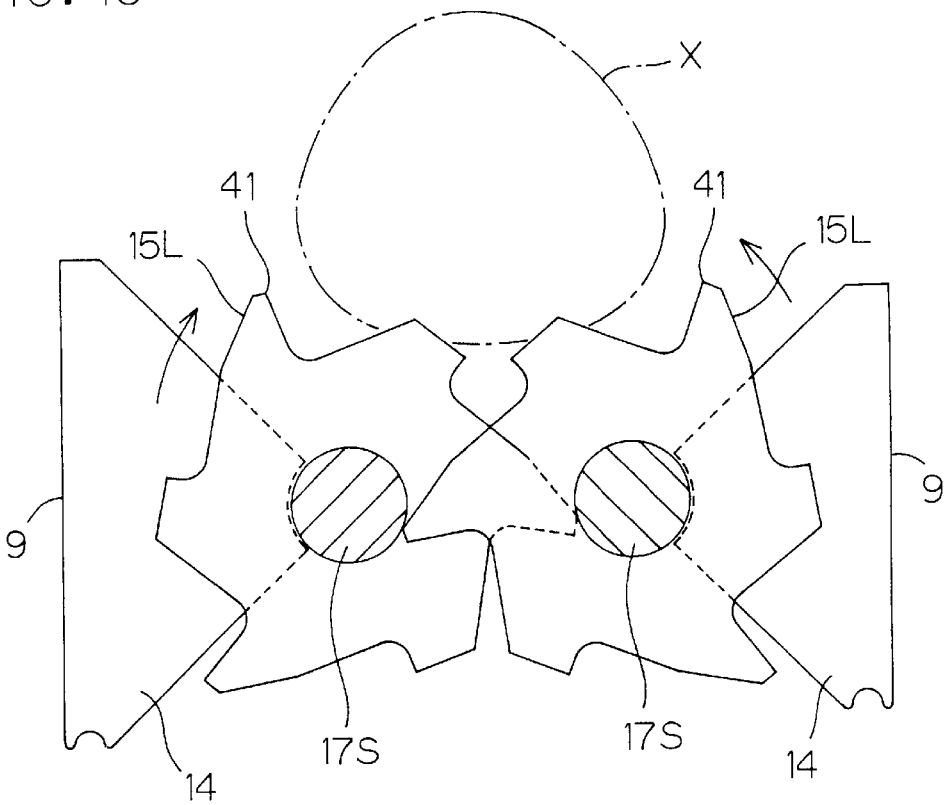
FIG. 13 is a view illustrating how a bone is taken by large-diameter disks.
Figure 14:
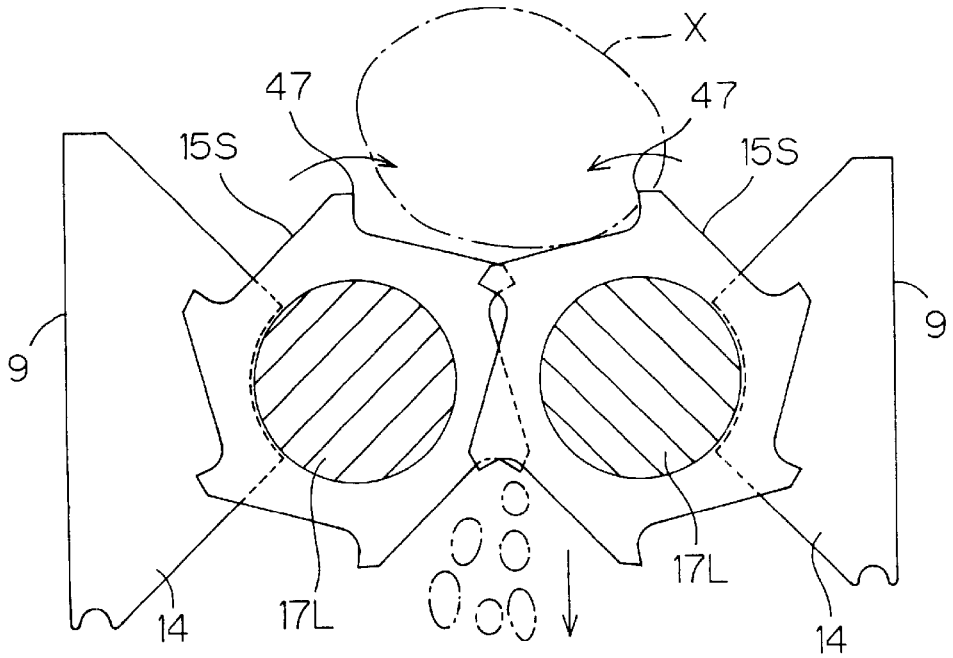
FIG. 14 is a view illustrating how a bone is taken by small-diameter disks.

FIG. 13 is a view illustrating how a bone X is taken by large-diameter disks 15L, and FIG. 14 is a view illustrating how the bone X is crushed by small-diameter disks 15S. As shown in FIG. 13, the bone X to be crushed which has been put in an upper portion of the mill case 3, is taken in between a pair of cutter units 12, 13 by biting blades 41 of the large-diameter disks 15L. At the same time, as shown in FIG. 14, the bone X thus taken is crushed by crushing blades 47 of the small-diameter disks 15S which are mutually inwardly rotated.

According to this embodiment, the left- and right-hand disks are rotated at different speeds of rotations. This makes it easier to take in and crush the bone X.

While the bone X is taken in and crushed, the outsides of the first cutter unit 12 and the second cutter unit 13 (the gaps between the cutter units 12, 13 and the lateral walls 9) are closed by the dusters 14. This prevents a large bone piece from falling down through these gaps. Further, the upper sides of the dusters 14 are inclined downwardly toward the center portions of the cutter units 12, 13. This guides the bone X to be crushed toward the center portions of the cutter units 12, 13.

Portions of the bone particles crushed as passing between the cutter units 12, 13, are rotated as attached to disks 15 or blades 40 (41, 42, 47). However, these particle portions come in collision with the lower sides having a falling gradient of the dusters 14. Thus, these particle portions are not returned back upwardly, but fall down.

Accordingly, all the crushed bone particles fall down in the container 7 without any waste.

Figure 15:
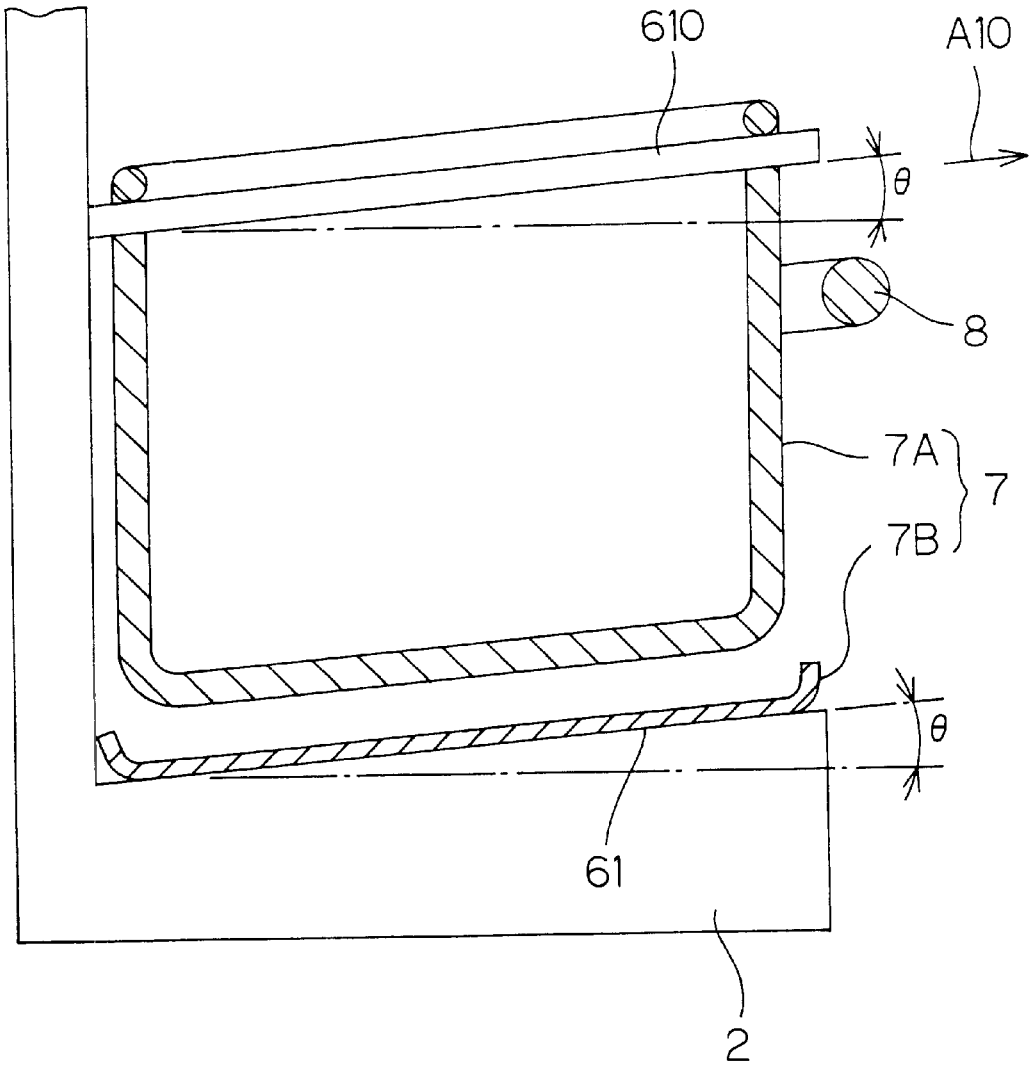
FIG. 15 is a schematic view illustrating the arrangement of a container and its housing structure.

FIG. 15 is a schematic view illustrating the arrangement of the container 7 and its housing structure. In FIG. 15, the right hand indicates the front face of the bone mill 1, and the container 7 can be pulled in the right direction.

Disposed under the mill case 3 is a placing face 61 on which the receiving member 7B is to be placed. The mill case has a pair of rails 610 as another example of a placing face which is engaged with the main container 7A. The main container 7A and the receiving member 7B can be pulled out in the direction shown by an arrow A10.

In this embodiment, the container 7 comprises a main container 7A which is deep, and a receiving member 7B which is shallow. Generally, it is not enough to crush a bone by passing, once, the bone between the first cutter unit 12 and the second cutter unit 13. Thus, the bone particles once crushed are again supplied to the gap between the first cutter unit 12 and the second cutter unit 13, and are again subjected to a crushing process. By repeating these feed and crushing several times, there can be obtained bone particle shaving the desired size. In this connection, after each bone crushing, the deep main container 7A is pulled out and the crushed bone particles therein are supplied again to the mill case 3 through its top opening. At this time, there are instances where crushed bone particles fall down from the gap between the cutter units 12, 13. To receive such falling bone particles, the receiving member 7B is disposed. This enables the crushed bone particles to be used without waste.

Each of the placing face 61 and the rails 610 has a gentle ascent of an angle θ in the container 7 pulling direction for the following reason. While the bone mill 1 is used, vibration is generated. Accordingly, when the placing face 61 and the rails 610 are horizontally placed, there are instances where the receiving member 7B placed on the placing face 61 and the main container 7A engaged with the rails 610, gradually spring out in the pulling direction due to the vibration. To prevent the container 7 from springing out, there may be disposed a lock mechanism arranged to prevent the container 7 from springing out. In view of the bone mill serving as a living-body operation tool, however, it is preferable to use a simple structure for facilitating cleansing and sterilization. In this connection, each of the placing face 61 and the rails 610 has an ascent to prevent the container 7 from sliding out when the bone mill 1 is under use, without the use of a lock mechanism for preventing the container 7 from springing out.

Figure 16:
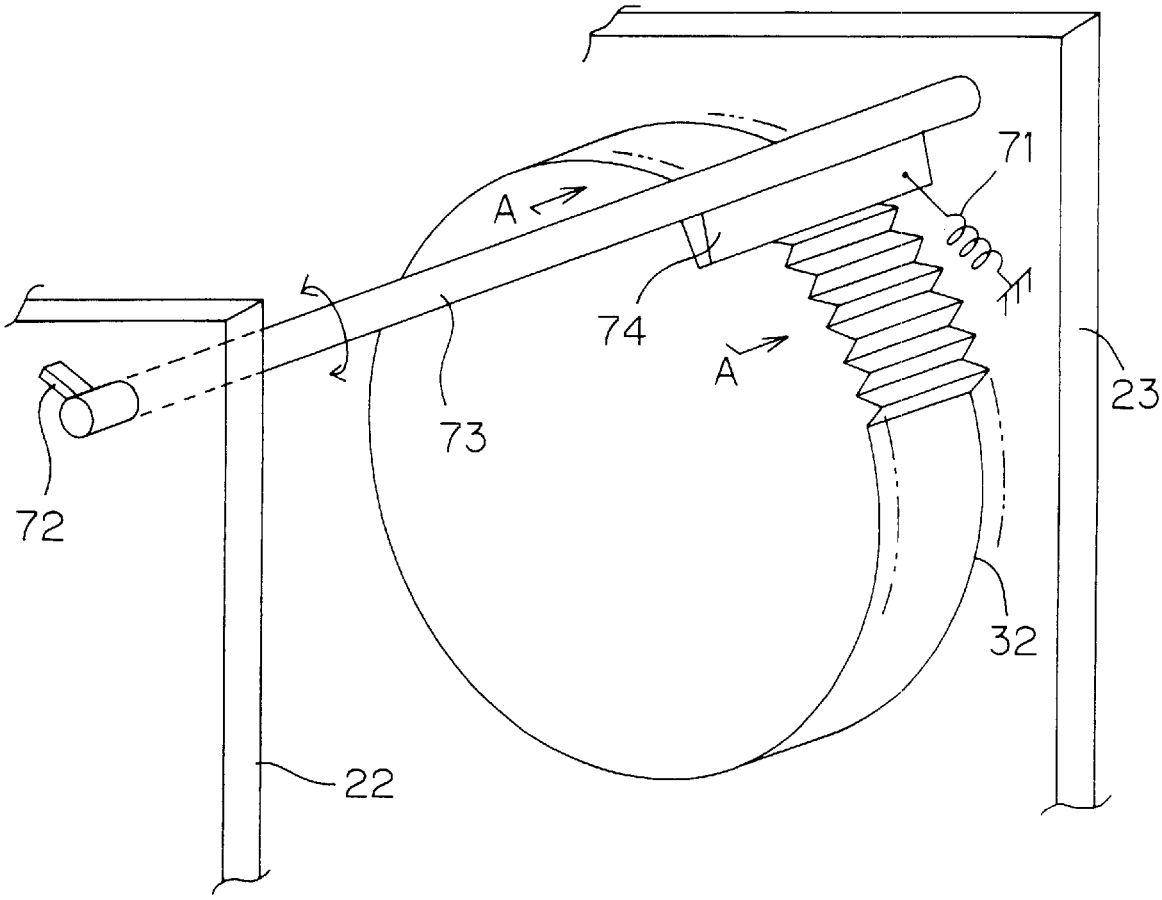
FIG. 16 is a view of a lock mechanism serving as a safety device disposed at the reduction gear mechanism.
Figure 17:
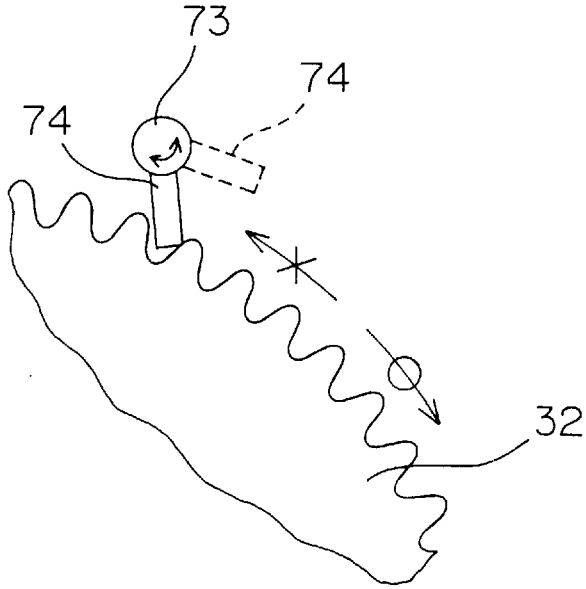
FIG. 17 is a view taken along the arrow A in FIG. 16.

Referring to FIGS. 16 and 17, the following description will discuss a lock mechanism, as a safety device, disposed at the reduction gear mechanism 30. This embodiment is arranged such that the cutter units 12, 13 are rotated only while the lid 5 is mounted. In this connection, there is disposed an actuating pin 72 arranged to be pressed down when the lid 5 is mounted, and to be turned up when the lid 5 is removed. The actuating pin 72 is disposed in association with the top opening of the mill case 3. The actuating pin 72 is attached to an end of an actuating rod 73 extending from the center support wall 22 to the right support wall 23. The displacement of the actuating pin 72 causes the actuating rod 73 to be rotated. Securely attached to the actuating rod 73 is a blade 74 to be engaged with the large-diameter second gear 32. When the actuating pin 72 is pressed down to cause the actuating rod 73 to be rotated counterclockwise, the blade 74 is disengaged from the second gear 32. On the other hand, when no force is externally exerted to the actuating pin 72, the actuating rod 73 is rotated clockwise due to the weight of the blade 74. As necessary, there may be disposed, as schematically shown in FIG. 16, a spring 71 for normally biasing the actuating rod 73 clockwise such that the actuating rod 73 is rotated by the resilient force of the spring 71. When the actuating rod 73 is rotated clockwise and the actuating pin 72 is turned up, the blade 74 is engaged with the second gear 32. This prevents the second gear 32 from rotating counterclockwise. Accordingly, only when the lid 5 is mounted on the mill case 3 such that the cutter units 12, 13 are not exposed, the cutter units 12, 13 can be mutually inwardly rotated.

It is preferably arranged such that the second gear 32 cannot be rotated counterclockwise but can be rotated clockwise when the blade 74 is engaged with the second gear 32. This can readily be achieved by managing the manner in which the blade 74 is engaged with the second gear 32.

The following description will discuss how to use the bone mill 1 with reference to FIG. 18 to FIG. 22.

Figure 18:
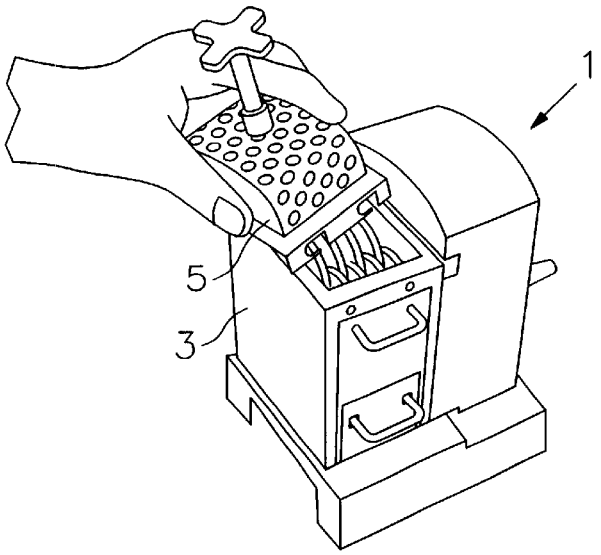
FIG. 18 to FIG. 22 are views illustrating how to use the bone mill.
Figure 19:
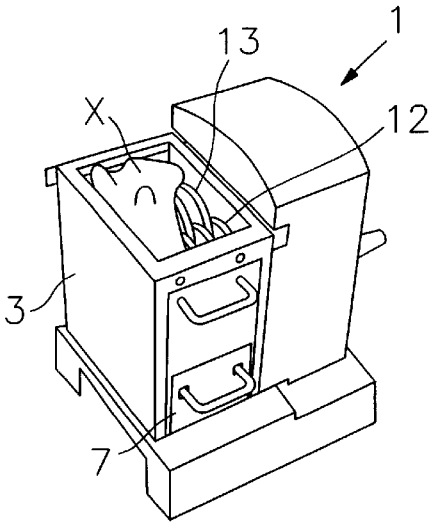
Figure 20:
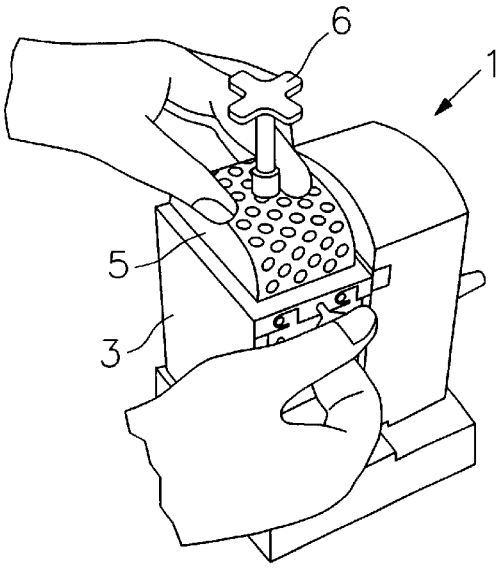

As shown in FIG. 18, the lid 5 is removed. Then, as shown in FIG. 19, a bone X to be crushed is put in the mill case 3. Then, as shown in FIG. 20, the lid 5 is mounted. When the lid 5 has the knob 6 for pushing the bone X down, the bone X can be pushed down by the knob 6.

Figure 21:
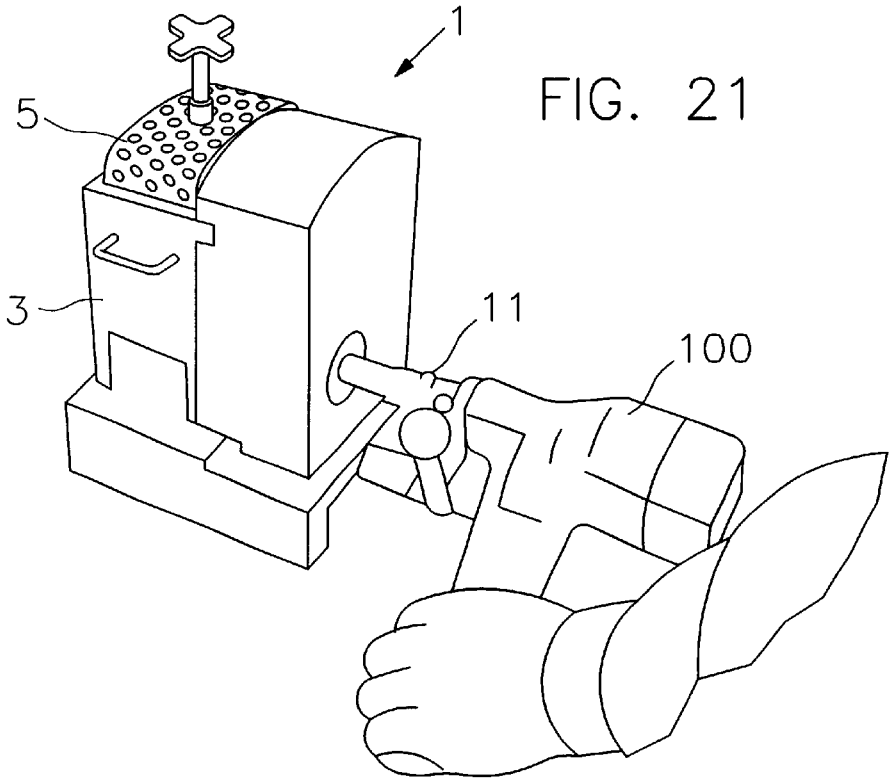

Then, as shown in FIG. 21, a totally enclosed water proof electric motor 100 as a power source is connected to the input shaft 11. Then, the input shaft 11 is rotated by the electric motor 100.

The totally enclosed waterproof electric motor 100 is used because a bone crushing process using the bone mill 1 is executed in an operation room or the like in parallel with the operation.

Figure 22:
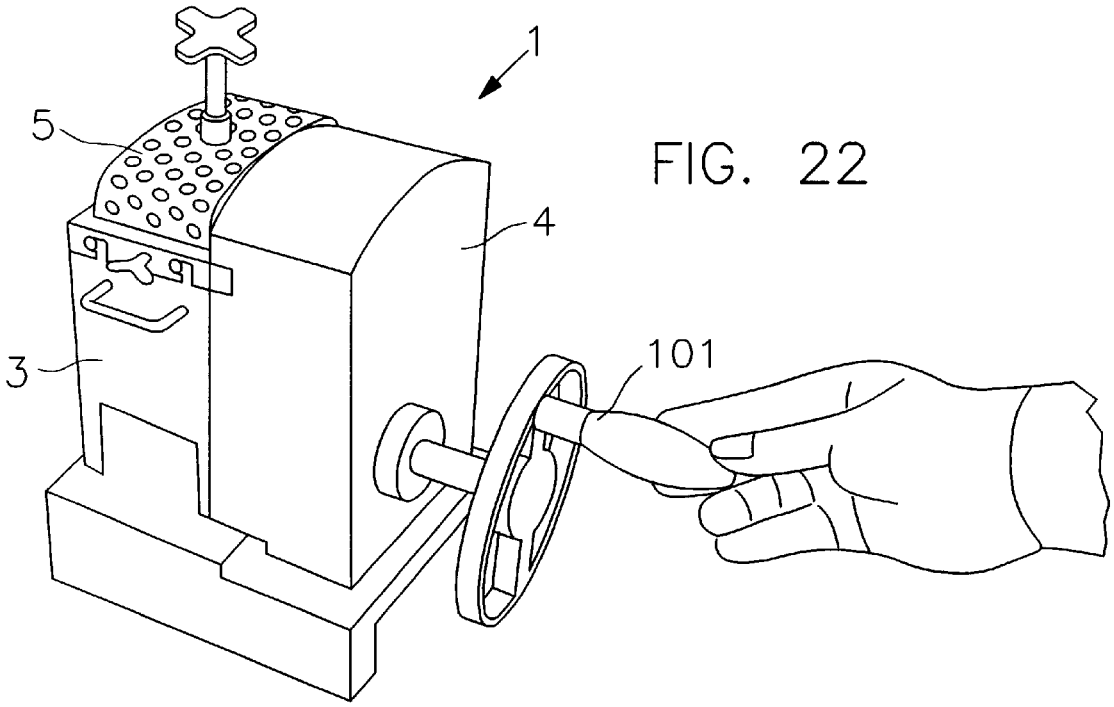

When the electric motor 100 is not used, a manual wheel 101 may be connected to the input shaft 11 for manually crushing the bone X, as shown in FIG. 22.

As to the bone mill 1 according to the embodiment above-mentioned, there has been discussed the disks 15 each of which has six blades. However, the number of the blades formed at each disk 15 may be one or a plural number. The thickness of each disk relates to the size of crushed bone particles. That is, when the target size of crushed bone particles is about 10 mm, each disk may have a thickness of about 10 mm.

The reduction gear mechanism 30 is not necessarily required, but may be omitted when an electric motor having great torque is used as the power source.

Further, the electric motor serving as a drive source may be formed in a unitary structure as connected to the bone mill 1.

With the use of the bone mill 1 discussed in the foregoing, bone crushing tests were conducted as follows.

In the tests, the reduction gear mechanism 30 of the bone mill 1 had a gear ratio of 1/30 and an ORTHOSTAR operation motor manufactured by KYOCERA CORPORATION was used as the electric motor 100.

EXAMPLE 1

Method: The cortex bone of the spherical condyle cut from the hip joint of a human body, was scraped off, and the condyle was entirely crushed.

Result: The bone crushing was completed without the bone mill 1 stopped even once. The crushed bone particles had a diameter of about 5 mm and were uniform in size. The crushing period of time was about 30 seconds.

EXAMPLE 2

Method: The cortex bone of the spherical condyle cut from the hip joint of a human body, was left as it is, and the condyle was entirely crushed.

Result: The bone crushing was completed without the bone mill 1 stopped even once. The crushed bone particles had a diameter of about 5 mm and were uniform in size. The crushing period of time was about 30 seconds.

The present invention should not be limited to the embodiments above-mentioned, but a variety of modifications can be made within the scope of the appended claims. The spirit and scope of the present invention are limited only by the appended claims.

What is claimed is:

1. A bone mill comprising a rotatable first cutter unit and a rotatable second cutter unit, each cutter unit having (i) a plurality of disks disposed in parallel to one another at regular intervals, each disk being provided on the periphery thereof with a blade, and (ii) a shaft which connects the centers of said disks to one another and which extends at a right angle to said disks, said cutter units being positioned such that said shafts are disposed substantially in parallel to each other, and such that disks of said first cutter unit are fitted in the gaps between adjacent disks of said second cutter unit, said bone mill further comprising a drive force transmission mechanism for mutually inwardly rotating said shaft of said first cutter unit and said shaft of said second cutter unit such that a bone to be crushed is taken in between said blades formed on said disks of said first cutter unit and said blades formed on said disks of said second cutter unit, at least one of said disks of each of said first and second cutter units having both at least one biting blade adapted to pull pieces of the bone to be crushed into the space between the first and second cutter units, and at least one crushing blade adapted to crush said bone pieces, wherein at least one of said first and second cutter units includes both a relatively large diameter disk having both at least one biting blade adapted to pull pieces of the bone to be crushed into the space between the first and second cutter units, and at least one crushing blade adapted to crush said bone pieces, and a relatively small diameter disk having at least one crushing blade but no biting blade.

2. The bone mill of claim 1, wherein:

the first cutter unit includes both a relatively large diameter disk having both at least one biting blade adapted to pull pieces of the bone to be crushed into the space between the first and second cutter units, and at least one crushing blade adapted to crush said bone pieces, and a relatively small diameter disk having at least one crushing blade but no biting blade; and the shaft of the second cutter unit varies in diameter along the length of the shaft and is configured so that a relatively large diameter portion of the shaft is disposed opposite the small diameter disk of the first cutter unit and a relatively small diameter portion of the shaft is disposed opposite the large diameter disk of the first cutter unit.

3. The bone mill of claim 2, wherein the shaft of the second cutter unit is configured so that the biting blade of the relatively large diameter disk of the first cutter unit only narrowly clears the shaft of the second cutter unit, and the crushing blade of the relatively small diameter disk of the first cutter unit only narrowly clears the shaft of the second cutter unit, as the first and second cutter units rotate together.

4. The bone mill of claim 1, wherein both of the first and second cutter units have more relatively small diameter disks having at least one crushing blade than they do relatively large diameter disks having both at least one biting blade and at least one crushing blade.

5. The bone mill of claim 4, wherein on both of the first and second cutter units, the ratio between the number of relatively small diameter disks having at least one crushing blade and the number of relatively large diameter disks having both at least one biting blade and at least one crushing blade is at least two to one.

6. The bone mill of claim 5, wherein one of said first and second cutter units has four relatively small diameter disks having at least one crushing blade, and two relatively large diameter disks having both at least one biting blade and at least one crushing blade.

7. The bone mill of claim 5, wherein one of said first and second cutter units has five relatively small diameter disks having at least one crushing blade, and two relatively large diameter disks having both at least one biting blade and at least one crushing blade.

8. A bone mill comprising a rotatable first cutter unit and a rotatable second cutter unit, each cutter unit having (i) a plurality of disks disposed in parallel to one another at regular intervals, each disk being provided on the periphery thereof with a blade, and (ii) a shaft which connects the centers of said disks to one another and which extends at a right angle to said disks, said cutter units being positioned such that said shafts are disposed substantially in parallel to each other, and such that disks of said first cutter unit are fitted in the gaps between adjacent disks of said second cutter unit, said bone mill further comprising a drive force transmission mechanism for mutually inwardly rotating said shaft of said first cutter unit and said shaft of said second cutter unit such that a bone to be crushed is taken in between said blades formed on said disks of said first cutter unit and said blades formed on said disks of said second cutter unit, at least one of said disks having both at least one blade arranged to draw a relatively larger rotational locus, and at least one blade arranged to draw a relatively smaller rotational locus.

9. The bone mill of claim 8, wherein at least one of said first and second cutter units includes both a relatively large diameter disk having both at least one blade arranged to draw a relatively larger rotational locus, and at least one blade arranged to draw a rotational locus relatively smaller than the relatively larger rotational locus, and a relatively small diameter disk having at least one blade arranged to draw a rotational locus relatively smaller than the relatively larger rotational locus.

10. The bone mill of claim 9, wherein:

the first cutter unit includes both a relatively large diameter disk having both at least one blade arranged to draw a relatively larger rotational locus, and at least one blade arranged to draw a rotational locus relatively smaller than the relatively larger rotational locus, and a relatively small diameter disk having at least one blade arranged to draw a rotational locus relatively smaller than the relatively larger rotational locus; and the shaft of the second cutter unit varies in diameter along the length of the shaft and is configured so that a relatively large diameter portion of the shaft is disposed opposite the small diameter disk of the first cutter unit and a relatively small diameter portion of the shaft is disposed opposite the large diameter disk of the first cutter unit.

11. The bone mill of claim 10, wherein the shaft of the second cutter unit is configured so that the blade of the relatively large diameter disk that is arranged to draw a relatively larger rotational locus of the first cutter unit only narrowly clears the shaft of the second cutter unit, and the blade of the relatively small diameter disk that is arranged to draw a rotational locus relatively smaller than that of the relatively larger rotational locus of the first cutter unit only narrowly clears the shaft of the second cutter unit, as the first and second cutter units rotate together.

12. The bone mill of claim 9, wherein both of the first and second cutter units have more relatively small diameter disks having at least one blade arranged to draw a rotational locus relatively smaller than the relatively larger rotational locus than they do relatively large diameter disks having both at least one blade arranged to draw a relatively larger rotational locus, and at least one blade arranged to draw a rotational locus relatively smaller than the relatively larger rotational locus.

13. The bone mill of claim 12, wherein on both of the first and second cutter units, the ratio between the number of relatively small diameter disks having at least one blade arranged to draw a rotational locus relatively smaller than the relatively larger rotational locus and the number of relatively large diameter disks having both at least one blade arranged to draw a relatively larger rotational locus, and at least one blade arranged to draw a rotational locus relatively smaller than the relatively larger rotational locus, is at least two to one.

14. The bone mill of claim 13, wherein one of said first and second cutter units has four relatively small diameter disks having at least one blade arranged to draw a rotational locus relatively smaller than the relatively larger rotational locus, and two relatively large diameter disks having both at least one blade arranged to draw a relatively larger rotational locus, and at least one blade arranged to draw a rotational locus relatively smaller than the relatively larger rotational locus.

15. The bone mill of claim 13, wherein one of said first and second cutter units has five relatively small diameter disks having at least one blade arranged to draw a rotational locus relatively smaller than the relatively larger rotational locus, and two relatively large diameter disks having both at least one blade arranged to draw a relatively larger rotational locus, and at least one blade arranged to draw a rotational locus relatively smaller than the relatively larger rotational locus.

* * * * *